United States Patent [19]

Shiobara

[11] Patent Number: 5,061,079

[45] Date of Patent: Oct. 29, 1991

[54] STIRRER

[75] Inventor: Katsumi Shiobara, Yono, Japan

[73] Assignee: Satake Chemical Equipment Mfg., Ltd., Moriguchi, Japan

[21] Appl. No.: 491,596

[22] Filed: Mar. 12, 1990

[30] Foreign Application Priority Data

| | | | |
|---|---|---|---|
| Mar. 10, 1989 | [JP] | Japan | 1-59150 |
| Mar. 15, 1989 | [JP] | Japan | 1-62685 |
| Apr. 4, 1989 | [JP] | Japan | 1-84098 |
| Apr. 5, 1989 | [JP] | Japan | 1-86044 |
| Apr. 25, 1989 | [JP] | Japan | 1-47738 |

[51] Int. Cl.[5] ..... B01F 13/08

[52] U.S. Cl. ..... 366/127; 366/273; 366/274; 91/DIG. 4

[58] Field of Search ..... 366/273, 274, 127, 241, 366/244, 349; 91/DIG. 4

[56] References Cited

U.S. PATENT DOCUMENTS

| | | | |
|---|---|---|---|
| 2,912,343 | 11/1959 | Collins et al. | 366/273 X |
| 3,172,645 | 3/1965 | Price | 366/273 |
| 3,452,973 | 7/1969 | Kawawa et al. | 366/273 X |
| 3,554,497 | 1/1971 | Zipperer | 366/274 X |
| 3,730,488 | 5/1973 | Gardner, Jr. | 366/273 X |
| 3,929,320 | 12/1975 | Haller | 366/274 X |
| 3,995,835 | 12/1976 | Cichy et al. | 366/273 |
| 4,199,265 | 4/1980 | Sanderson et al. | 366/274 |
| 4,209,259 | 6/1980 | Rains et al. | 366/273 |
| 4,568,195 | 2/1986 | Herz et al. | 366/274 |
| 4,691,725 | 9/1987 | Parisi | 366/127 X |

*Primary Examiner*—David Trafton
*Assistant Examiner*—Joseph A. Rhoa
*Attorney, Agent, or Firm*—Oblon, Spivak, McClelland, Maier & Neustadt

[57] ABSTRACT

A stirrer for stirring a liquid in a container, which includes a stator; a rotor disposed in the container and provided with stirring vanes; and a cylindrical housing of nonmagnetic material having a peripheral wall thereof interposed between the stator and rotor and rotatably supporting the rotor through intervention of the liquid. This arrangement provides a stirrer of simple and compact construction, which can stir the liquid in a container completely in a closed state free of sliding portions of rotary components or shaft seal portions.

5 Claims, 18 Drawing Sheets

STIRRER

BACKGROUND OF THE INVENTION

1. Field of the Invention

This invention relates to a stirrer which is useful particularly in pharmaceutical, food and chemical industries for mixing, dissolving, kneading and diffusing a liquid or other material in a container.

2. Discussion of the Background

Illustrated in FIG. 30 is a known mixer which is provided with a stirring vessel a, a rotational transmission c located externally under the bottom wall of the stirring vessel a and driven from an electric motor b, and an impeller shaft e which protrudes from below into a lower portion of the vessel a and having impeller vanes d. The impeller shaft e and the transmission c are coupled to each other through a magnetic coupling f to rotate the impeller wheel d.

This sort of conventional stirrer is required to separately provide a rotational drive like the motor b for rotating the impeller vanes d which invariably have drawbacks in that they are of complex construction and are large in size.

SUMMARY OF THE INVENTION

It is an object of the present invention to provide a stirrer which is capable of stirring a liquid in a container in a completely closed state with no slide portions of rotary components nor a shaft seal portion being required.

It is another object of the invention to provide a stirrer which is compact construction and is reduced in size.

In accordance with the present invention, the foregoing objects are achieved by the provision of a stirrer for stirring a liquid in a container, which essentially includes a cylindrical housing of nonmagnetic material having the peripheral wall portion thereof interposed between a stator and a rotor with stirring vanes for supporting the rotor rotatably through intervention of the liquid from the container.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Now, the invention will be described more particularly, firstly by way of the first embodiment shown in FIGS. 1 through 4.

Figure 1:
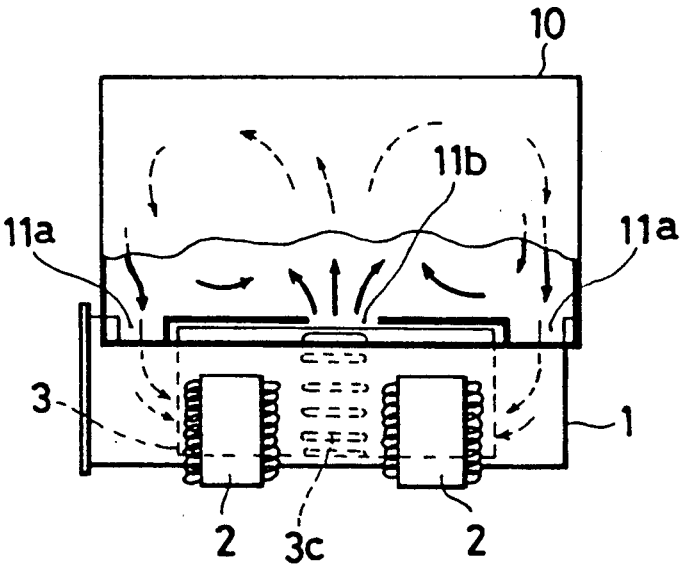
FIG. 1 is a plan view of a first embodiment of the invention.
Figure 2:
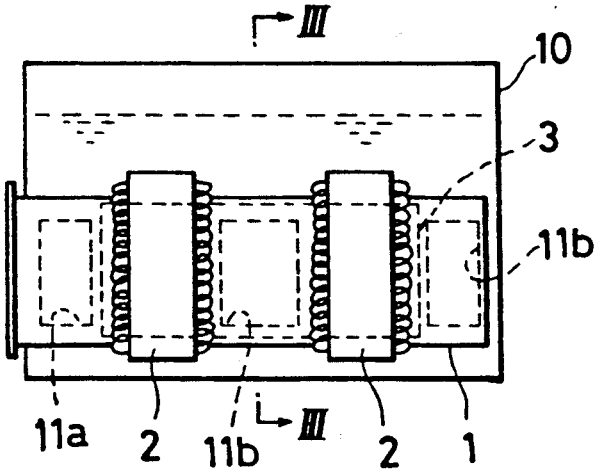
FIG. 2 is a front view of the embodiment of FIG. 1.
Figure 3:
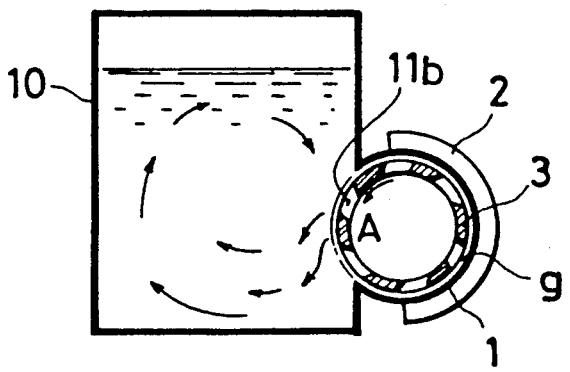
FIG. 3 is a cross-sectional view taken on line III—III of FIG. 2.
Figure 4:
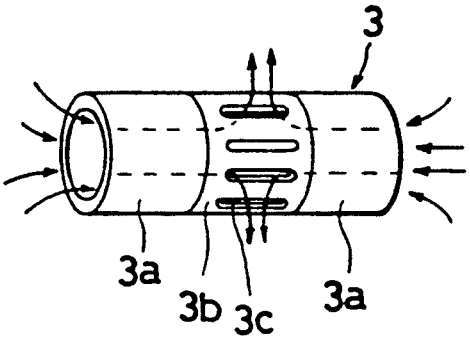
FIG. 4 is a perspective view of a rotor.

In these figures, indicated at 10 is a rectangular liquid container and at 1 is a cylindrical housing of a nonmagnetic material which is projectingly provided in a lower portion of one side wall of the liquid container 10. The housing 1 is hermetically closed at opposite ends thereof, and provided with first communication ports 11*a* at opposite end portions of the peripheral wall thereof and a second communication port 11*b* in a center portion of the peripheral wall. Thus, the housing 1 is communicable with the liquid container 10 through the just-mentioned first and second communication ports 11*a* and 11*b*. Received in the housing 1 is a hollow cylindrical rotor 3 which is open at the opposite ends and which leaves a small clearance or gap g therearound as shown in FIG. 3. The rotor 3 has cylindrical opposite end portions 3*a* which comprise a coated magnetic material such as SS41 or the like and a conductive body of copper, aluminum or the like, as well as a cylindrical center portion 3*b* which is constituted by stainless steel, engineering plastics or the like. As shown in FIGS. 3 and 4, a large number of inclined openings or slots 3*c* are provided in the center portion 3*c* to function as a stirring portion. The rotor 3 as a whole is coated with Teflon or other corrosion-resistant material.

Rotating field devices, namely, stators 2, are located on the outer side of the housing 1 opposingly to the cylindrical end portions 3*a* of the rotor 3. In this instance, each one of the stators 2 is constituted by a multi-layered iron core of silicon steel sheets or the like and a winding wound around the core.

With the above-described arrangement, rotating fields are induced in the cylindrical portions 3*a* of the rotor 3 as soon as current is conducted through the stator 2, whereupon the liquid is drawn into the gap g by the rotor 3 to produce a bearing effect, rotating the rotor 3 smoothly in a noncontacting state in the direction of arrow A in FIG. 3 by the balancing action between the attraction of the rotating fields and gravity acting on the rotor 3. At this time, since the rotor 3 is provided with the slots 3*c* in the center portion 3*b*, the liquid which flows in through the first communicating ports 11*a* of the housing 1 is sucked into the rotor 3 through the openings at the opposite ends thereof, while the liquid in the rotor 3 is stirred as it is discharged through the slots 3*c* to return to the container 10 through the second communication port 11*b*. This is repeated to stir the liquid in the container 10.

Figure 5:
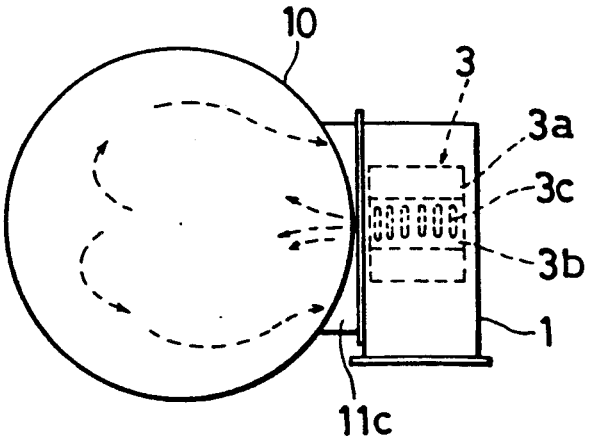
FIG. 5 is a plan view of a second embodiment of the invention.
Figure 6:
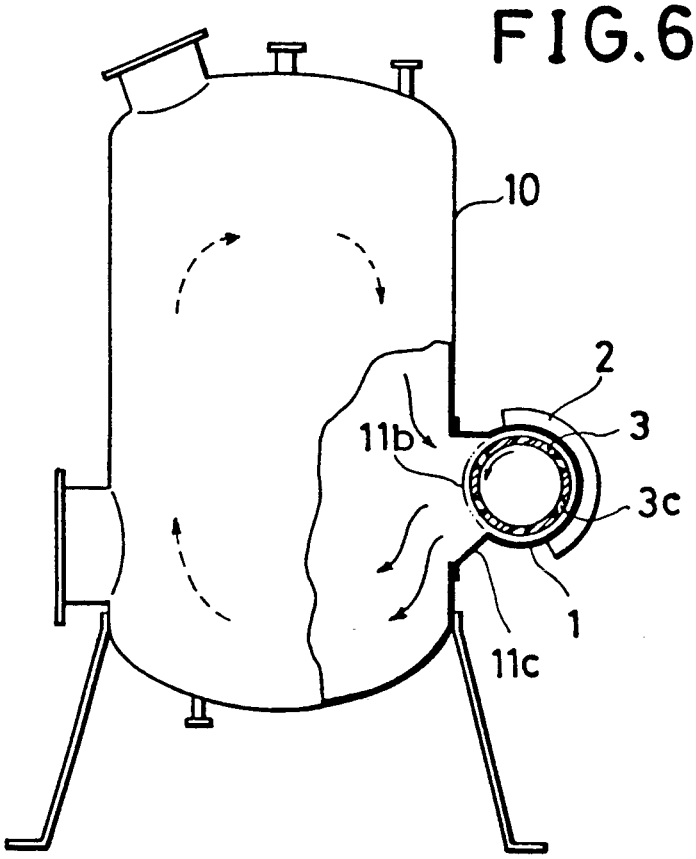
FIG. 6 is a partly cutaway front view of the embodiment of FIG. 5.

Referring now to FIGS. 5 and 6, there is shown a second embodiment of the invention which employs a vertical type cylindrical liquid container 10 with a rectangular open frame 11*c* projecting from a lower portion of its side wall, and a cylindrical housing 1 fixedly connected in a hermetically sealed state to the frame 11*c* along the edges of a rectangular opening formed on one side of the housing 1. In the same manner as in the foregoing first embodiment, upon rotating the rotor 3 by supplying current to the stator 2, the liquid flowing toward the opposite end portions of the open frame 11*c* from the container 10 is sucked into the openings at the opposite ends of the rotor 3 and then discharged through the slots 3*c* into the center portion of the open frame 11*c* to return to the container 10. The liquid in the container 10 is thus stirred by repeated circulation through the rotor 3. This embodiment has an advantage in that the housing 1 is easily detachable from the container 10 to facilitate their transportation or maintenance and service.

Figure 7:
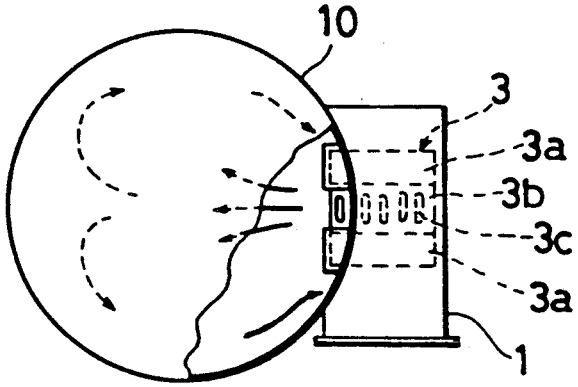
FIG. 7 is a partly cutaway plan view of a third embodiment of the invention.
Figure 8:
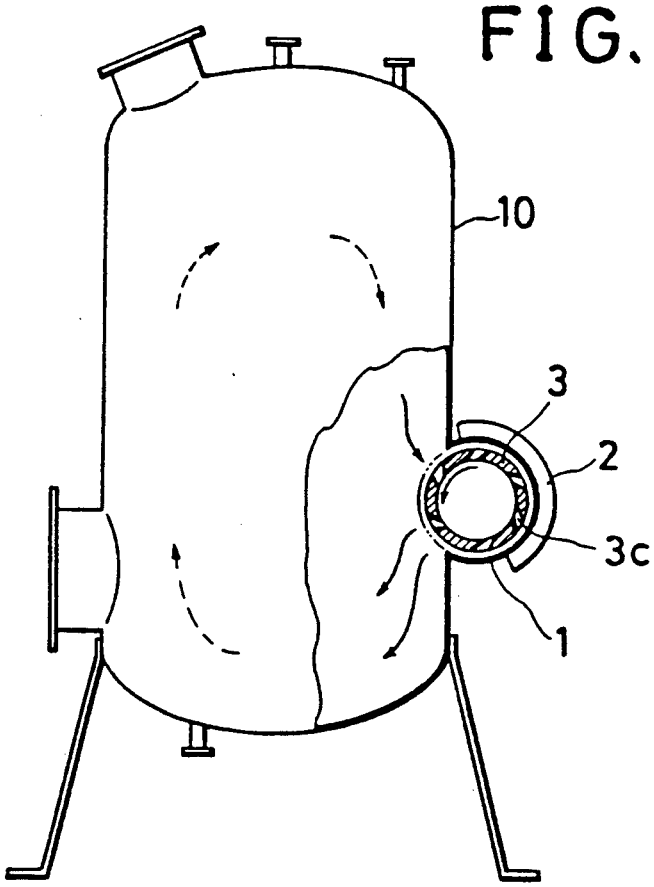
FIG. 8 is a partly cutaway front view of the embodiment of FIG. 7.
Figure 9:
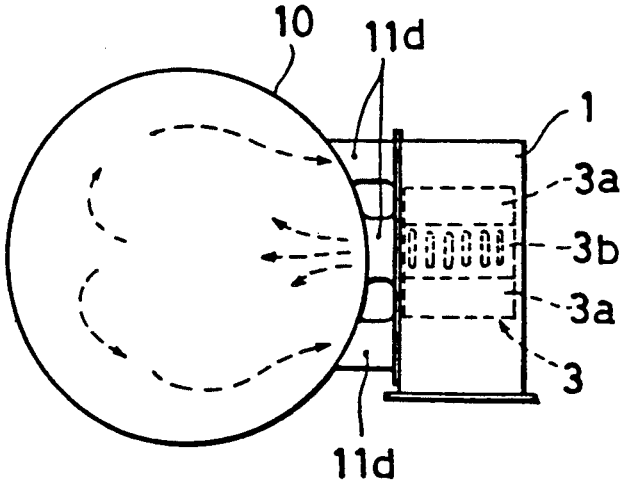
FIG. 9 is a plan view of a fourth embodiment of the invention.

FIGS. 7 and 8 illustrate a third embodiment of the invention, which employs a vertical type cylindrical liquid container 10 with a housing 1 hermetically and integrally connected to an opening in the side wall of the container 10 for effective use of the installation space. This embodiment is suitable for application, particularly in a case where only a limited floor space is available, and can perform the stirring operation in substantially the same manner as the foregoing second embodiment.

Shown in FIG. 4 is a fourth embodiment of the invention, wherein a housing 1 is spaced more from a container 10 than in the above-described second embodiment and communicated with the latter through three ducts 11*d*, more specifically, a couple of side ducts 11*d* and a center duct 11*d*. The stirring operation is substantially the same as in the first embodiment. With this fourth embodiment, the stator 2 can circumvent the rotor 3 to a greater degree to enhance the rotational efficiency.

Figure 10:
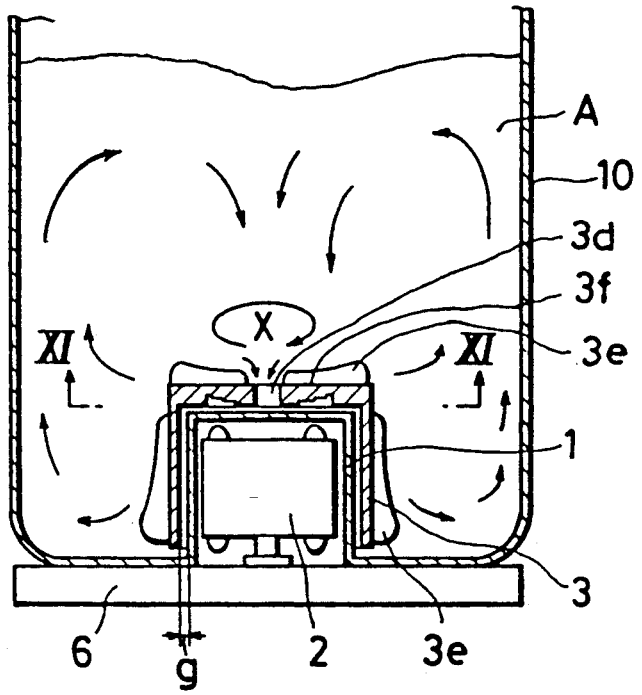
FIG. 10 is a vertical section of a fifth embodiment of the invention.
Figure 11:
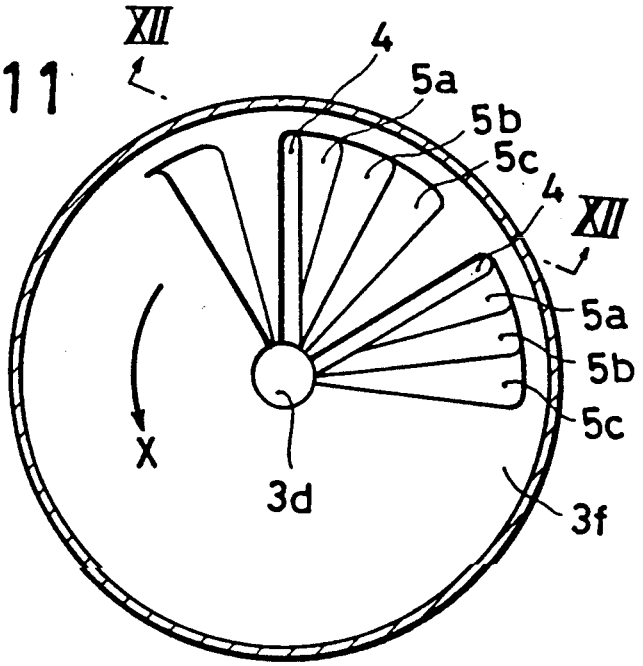
FIG. 11 is a sectional view taken on line XI—XI of FIG. 10.
Figure 12:
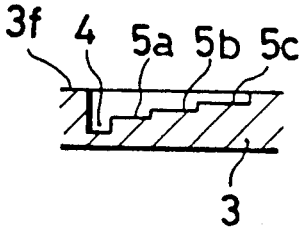
FIG. 12 is a sectional view taken on line XII—XII of FIG. 11.

Referring to FIGS. 10 to 12, there is shown a fifth embodiment of the invention, which is of a type having a housing 1 formed within an indented bottom wall portion of a stirring container 10. More specifically, the housing 1 is formed of a nonmagnetic material at least in those portions which oppose the rotor 3 as will be described hereinafter, and in this case formed by an indented portion which is provided in a center portion of the bottom wall of the container 10 in such a manner as to circumvent the stator 2. Denoted at 3 is a rotor which is formed in a cap-like shape and which has its peripheral wall portion formed of a magnetic material such as SS41 or the like and a conducting body of copper, aluminum or the like. The top wall of the rotor 3 is formed of stainless steel, engineering plastics or the like. The rotor 3 as a whole is coated with a corrosion-proof material sold under the TEFLON trademark. The rotor 3 is fitted on the housing 1 which circumvents the stator 2, and is provided with an aperture 3*d* at the center of its top wall and with a plurality of stirring vanes 3*e* on the peripheral and top wall surfaces. As shown particularly in FIGS. 11 and 12, a plurality of radial strip-like grooves 4 are cut into the inner surface 3*f* of the top wall of the rotor 3 at uniform angular intervals in the circumferential direction. Each groove 4 is connected to stepped surfaces 5*a* to 5*c* of a sectoral shape. Indicated at 6 is a fixed base for mounting the housing 1 and stator 2.

This embodiment operates as follows.

Upon supplying current to the stator 2 to produce shifting fields, the rotor 3 is rotationally driven in the direction of arrow X for stirring the liquid A with the vanes 3*e* on the rotor 3.

In this instance, since the rotor 3 is provided with aperture 3*d* at the center of its top wall, the liquid A which is urged to flow into the grooves 4 through the aperture 3*d* by rotation of the rotor 3 is firstly supplied to the peripheral portions of the respective grooves 4. As the liquid proceeds successively from the first to third sectoral stepped surfaces 5*a* to 5*c*, the liquid pressure is increased stepwise, producing a pressure which acts upwardly on the rotor 3 to float the same upward, while part of the liquid A is forced to flow downward through the small gap g between the housing 1 and rotor 3.

In this manner, the gap g is constantly maintained and the rotor 3 is rotated smoothly in a balanced state with the reaction forces of the top stirring vanes 3*e* and circumferential stirring vanes 3*e*.

As is clear from the foregoing description, the stirring apparatus of this embodiment employs a noncontacting rotor for the stirring operation, so that it can be applied to either a sealed or nonsealed type container and facilitates stirring operations under high pressure or in a vacuum, free of abrasive wear as would result from sliding movements and free from the generation of vibrations. Moreover, the liquid A in the container 10 can be discharged more easily after stirring operation.

Figure 13:
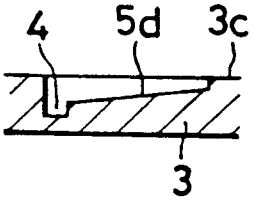
FIG. 13 is a view similar to FIG. 12 but showing a sixth embodiment of the invention.

Referring to FIG. 13, there is illustrated a sixth embodiment of the invention, in which the stepped surfaces 5*a* to 5*c* of the foregoing fifth embodiment are replaced by an infinite number of stepped surfaces, namely, by a linearly inclined surface 5*c* to obtain the same effects as in the fifth embodiment.

Figure 14:
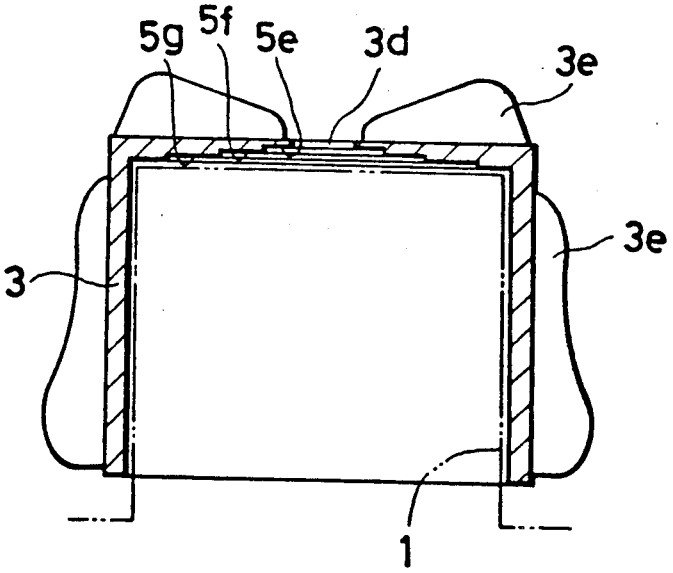
FIG. 14 is a vertical section of a rotor of a seventh embodiment of the invention.
Figure 15:
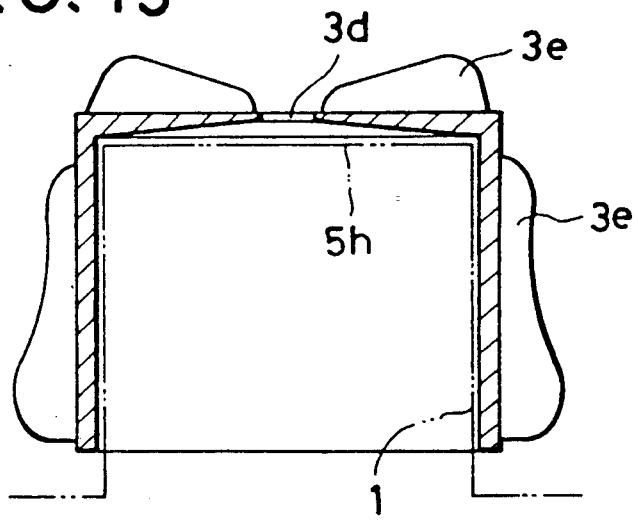
FIG. 15 is a vertical section of a rotor of an eighth embodiment of the invention.

Illustrated in FIG. 14 is a seventh embodiment of the invention, in which stepped surfaces 5*e* to 5*g* are formed on the rotor 3 in the circumferential direction and concentrically in a manner so as to minimize the gap toward the outer periphery. FIG. 15 shows an eighth embodiment in which the number of the stepped surfaces 5*e* to 5*g* is increased infinitely to present a linearly inclined surface 5*h*. In the seventh and eighth embodiments, the liquid which is urged to flow into the aperture 3*d* by rotation of the rotor 3 is forced outward in the gap between the top wall of the rotor 3 and the top surface of the housing 1 under the influence of the centrifugal force. Since the gap is narrowed toward the outer periphery, the liquid pressure is increased outwardly, generating a pressure which pushes up the rotor 3 into a floating state for smooth rotation.

Although the grooves and stepped surfaces are formed on part of the rotor 3 in the fifth to eighth embodiments, they may be formed on the top surface of the housing 1 if desired.

Figure 16:
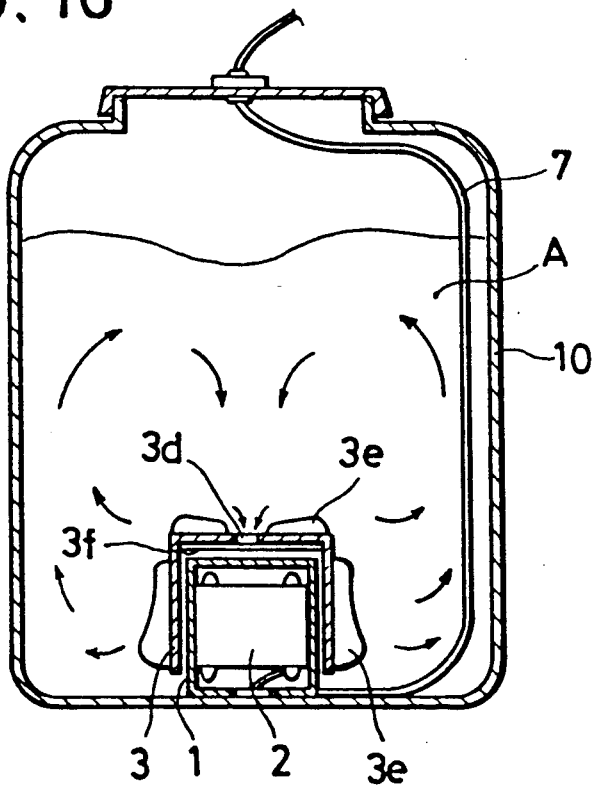
FIG. 16 is a vertical section of a ninth embodiment of the invention.

Shown in FIG. 16 is a ninth embodiment of the invention, in which a closed type housing 1 of a nonmagnetic material is formed separately from the container 10 for the liquid A, and receives therein a stator 2. A rotor 3 is fitted on the housing 1, and grooves and stepped surfaces or a linearly inclined surface are formed on the inner surface of the top wall of the rotor or on the top surface of the housing 1 as in the fifth to eighth embodiments. This stirrer can be placed in an ordinary container. Reference number 7 indicates a lead wire.

Figure 17:
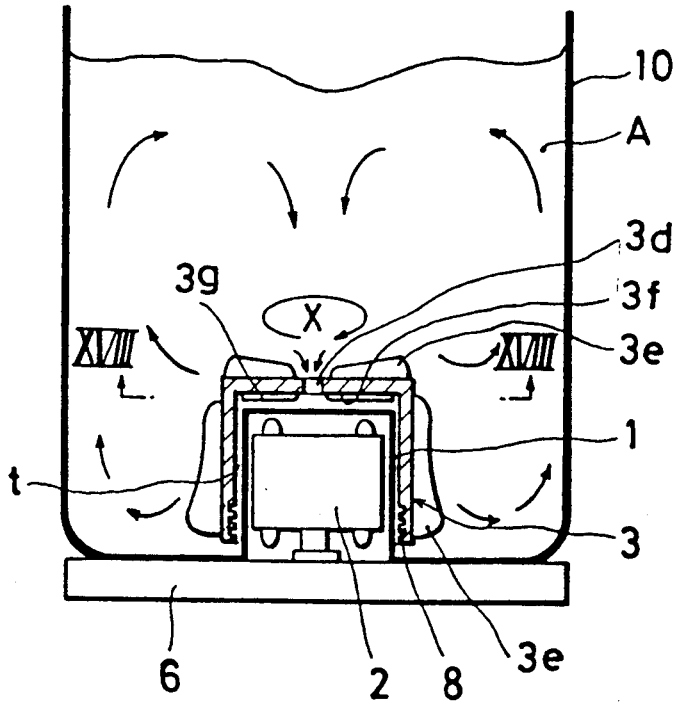
FIG. 17 is a vertical section of a tenth embodiment of the invention.
Figure 18:
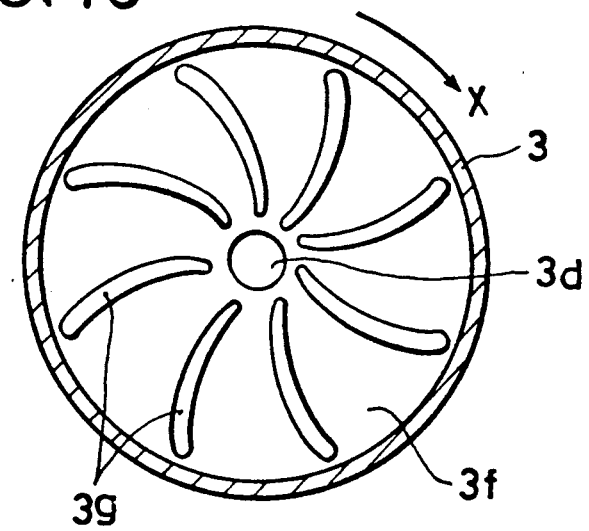
FIG. 18 is an enlarged sectional view taken on line XVIII—XVIII of FIG. 17.
Figure 19:
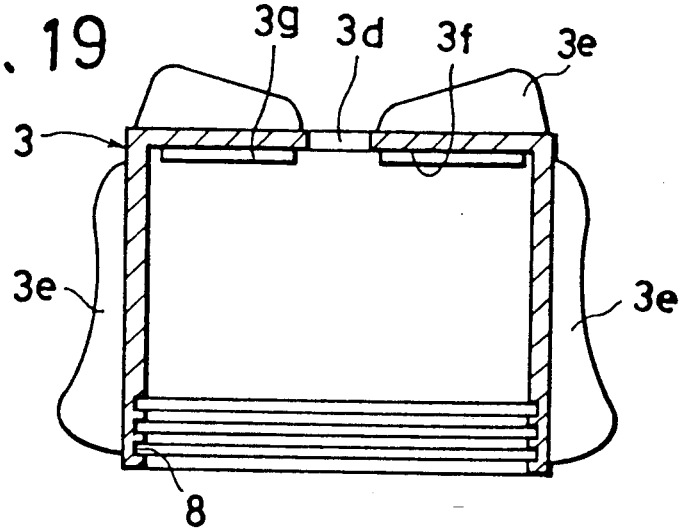
FIG. 19 is a vertical section of a rotor.

Referring to FIGS. 17 to 19, there is illustrated a tenth embodiment of the invention, wherein pumping vanes 3*g* which are curved in the circumferential direction are projectingly provided on the inner surface of the top wall of a rotor 3 as shown particularly in FIGS. 18 and 19. In addition, a number of labyrinths 8 are formed on the inner periphery at the lower end of the peripheral wall of the rotor 3.

Thus, supplying current to the stator 2 to generate shifting fields which drive the rotor 3 to rotate in the direction of arrow X, the liquid A which is urged to flow into the gap between the opposing surfaces of the rotor 3 and the housing 1 through the aperture 3*d* is forcibly pushed outward by the pumping vanes 3*g* on the inner surface 3*f* of the top wall of the rotor 3 with an outwardly increasing liquid pressure to push up the rotor 3 before flowing down through the gap between the opposing peripheral wall surfaces of the housing 1 and rotor 3. Due to the existence of the labyrinths 8 at the lower end of the rotor 3, downward flow of the liquid A is blocked there to a substantial degree so as to float the rotor 3 upward securely while in rotation. Accordingly, the rotor 3 is rotated smoothly, balancing with the reaction forces of the stirring vanes 3*e* on its peripheral wall, and consequently the liquid A is stirred by the vanes of the rotor 3.

Although the pumping vanes 3*g* are provided on part of the rotor 3 in this embodiment, of course they may be formed on the top wall of the housing 1.

Further, the labyrinths 8 which are formed on the inner peripheral surface at the lower end of the rotor 3 may be provided at an intermediate portion on the inner periphery of the rotor 3 or on the outer peripheral surface of the housing 1 if desired.

Figure 20:
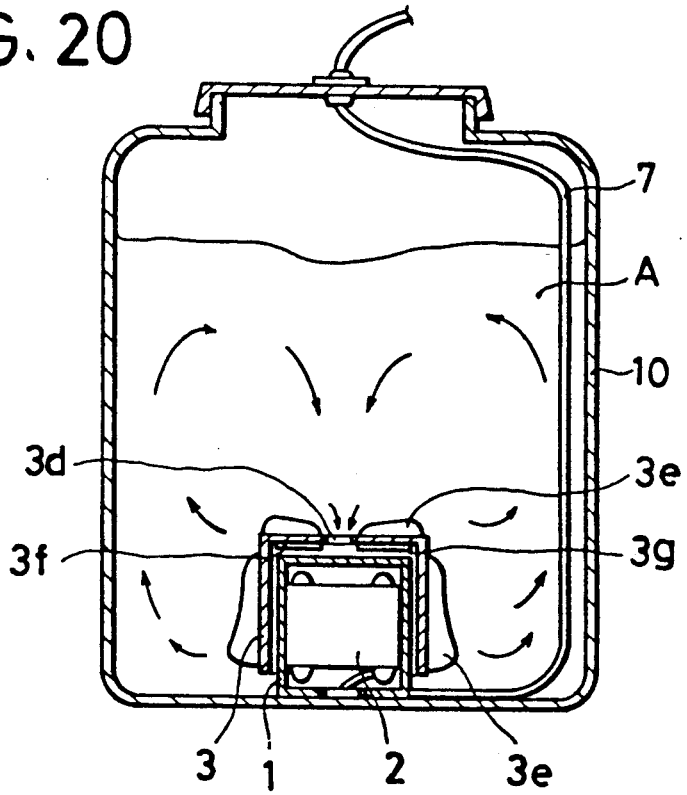
FIG. 20 is a vertical section of a modification of the stirrer of the tenth embodiment arranged in the fashion of the ninth embodiment.

Moreover, instead of forming the housing 1 by part of the container 10 as in the present embodiment, a closed type housing 1 may be formed separately from the container 10 as shown in FIG. 20 in a manner similar to the ninth embodiment, receiving a stator 2 in the housing 1 and fitting a rotor 3 over the housing 1. In this case, pumping vanes 3*g* are provided either on part of the rotor 3 or on the opposing surface of the top wall of the housing 1. Further, labyrinths 8 may be provided on the rotor 3 or on the opposing peripheral surface of the housing 1.

Figure 21:
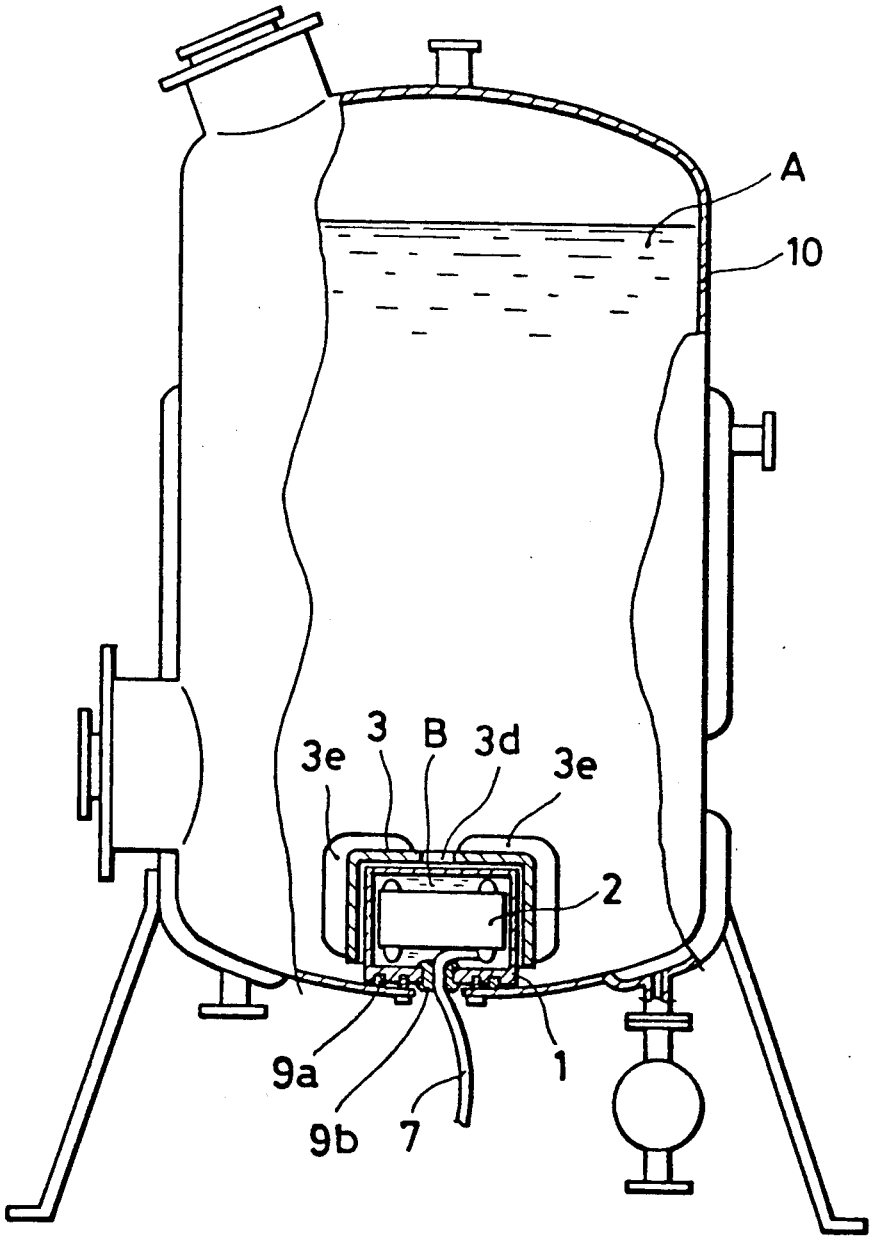
FIG. 21 is a partly cutaway sectional view of an eleventh embodiment of the invention.

Referring to FIG. 21, there is shown an eleventh embodiment of the invention, in which a housing 1 is fixed by screws to a lower portion of a stirring container 10 through an O-ring 9*a* or other suitable seal member. Indicated at B is an incompressible fluid in liquid form which is filled in the housing 1 and in the gap space around a stator 2. Lead wire 7 from the stator 2 is passed through a seal 9*b*. Thus, when the container 10 is under high pressure, the compressive force which acts on the housing 1 through the liquid A is sustained by the incompressible fluid B filled in the housing 1. It follows that the wall thickness of the housing 1, particularly, the thickness of the peripheral wall portion can be reduced to enhance the efficiency of the motor.

Figure 22:
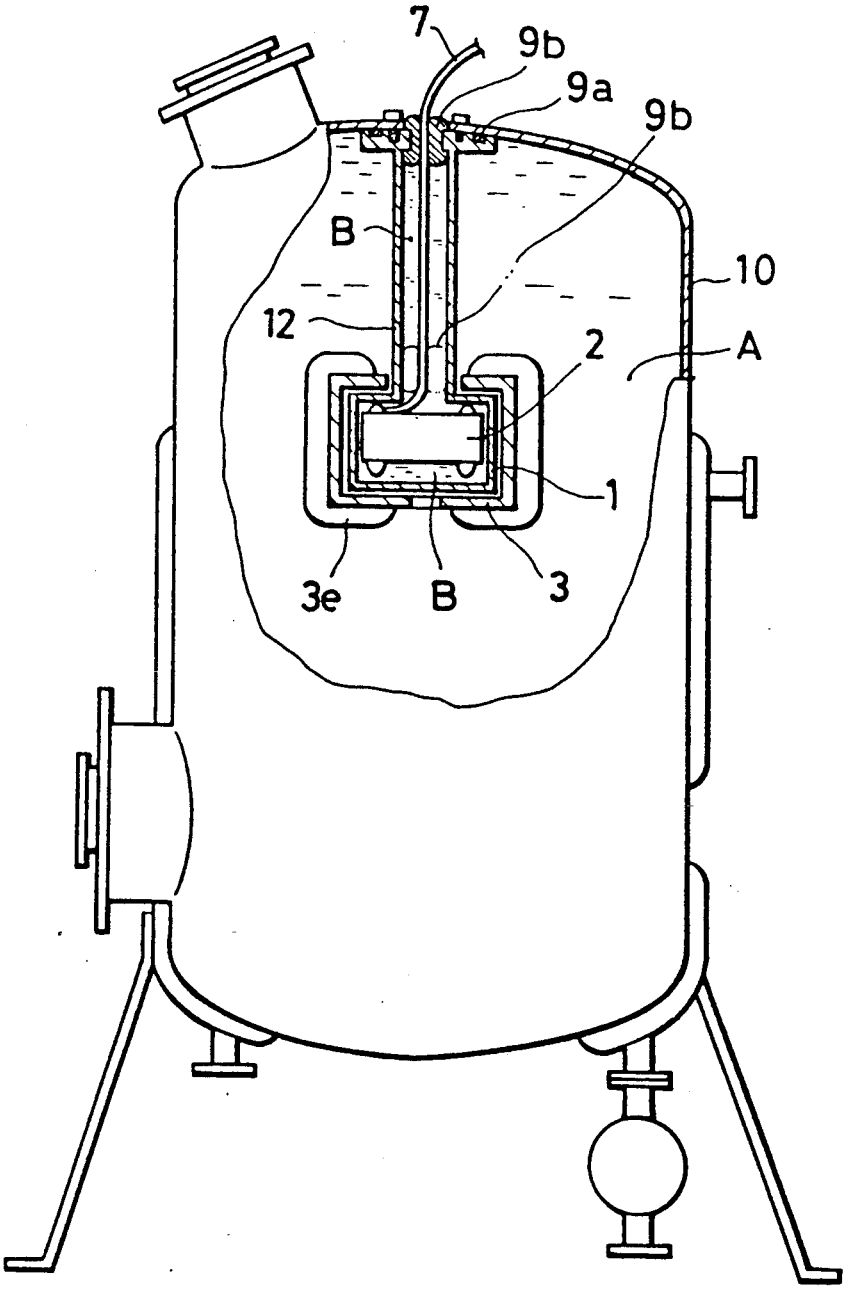
FIG. 22 is a partly cutaway sectional view of a twelfth embodiment of the invention.

Illustrated in FIG. 22 is a twelfth embodiment of the invention, in which a housing 1 is suspended from the top wall of a stirring container 10 by means of a hollow cylindrical support member 12. The housing 1 is in communication the cylindrical support member 12 which is filled with an incompressible fluid B. A seal 9*b* is provided at the upper end of the support member 12. In this embodiment, the rotor 3 is formed in C-shape in section.

The incompressible fluid B may be filled in the housing 1 alone, locating the seal 9*b* in the position indicated by broken line in FIG. 22.

Figure 23:
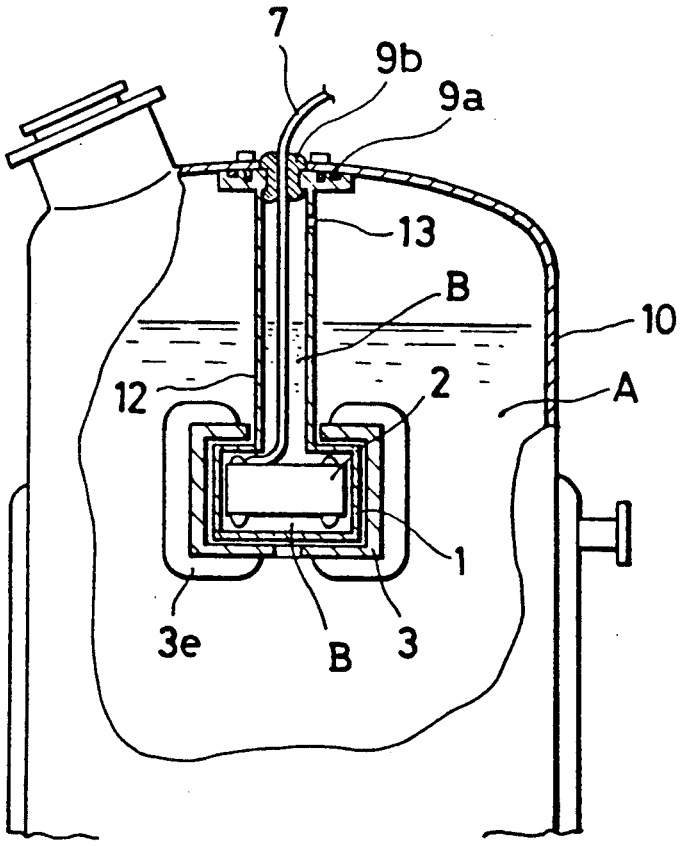
FIG. 23 is a partly cutaway sectional view of a thirteenth embodiment of the invention.

FIG. 23 shows a thirteenth embodiment of the invention, in which a communication hole 13 is formed in an upper portion of a hollow cylindrical support member 12 and the fluid B is filled in a housing 1 and only in lower portion of the support member 12, leaving an empty space thereabove. Accordingly, when stirring the container 10 under high pressure, the upper empty space in the support member 12 is raised to the same pressure level by communication with the upper empty space in the container 10 through the communication hole 13, as a result zeroing on equalizing the pressure difference between inside and outside of the housing 1 and the cylindrical support member 12. This permits a reduction in their wall thicknesses so as to enhance the motor efficiency.

Alternatively, the hollow spaces in the casing 1 and support member 12 may be entirely emptied and filled with the high pressure gas in the upper space of the container 10 by communication therewith through the communication port 13, instead of the fluid B.

Although a situation where a high pressure prevails in the container 10 has been described as an example in each one of the foregoing eleventh to thirteenth embodiments, there occurs almost no pressure difference between inside and outside of the housing 1 even under low pressure or vacuum condition, permitting a reduction in the wall thickness of the housing 1. The housing 1 which has been shown as being fixed in the container 10 in the eleventh to thirteenth embodiments may be provided as an independent closed type which can be set in an arbitrary position within an existing container.

Figure 24:
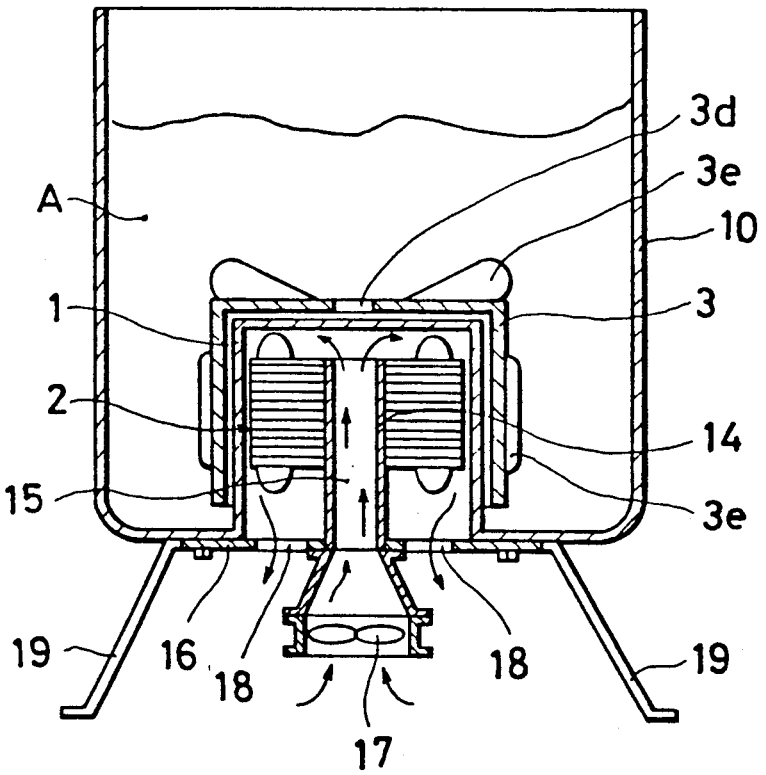
FIG. 24 is a vertical section of a fourteenth embodiment of the invention.

Referring to FIG. 24, there is illustrated a fourteenth embodiment of the invention, wherein a pipe 14 is inserted in a center aperture of a stator 2 to form an air passage 15. The lower end of the pipe 14 is passed through and fixed to a support plate 16 which supports the container 10, the side walls of the pipe 14 being spread into a trumpet-like shape under the support plate 16 to accommodate a fan 17. Indicated at 18 are openings which are formed in the support plate 16, namely, in the bottom wall of the housing 1 beneath the peripheral wall portions of the stator 2, and indicated at 19 are legs which support the container 10.

Upon generating shifting fields by supplying current to the stator 2, the rotor 3 is rotated on the liquid bearing which is formed in the small clearance between the rotor 3 and the housing 1, stirring the liquid A with the vanes 3*e* which are provided on the rotor 3. As the fan 17 is actuated, the air which is drawn by the fan 17 is sent into the air passage 15 and circulated through the housing 1 and along the peripheral wall portions of the stator 2 before being discharged through the openings 18. As a result of this air circulation, the housing 1 is cooled and the stator is smoothly rotated so as to stir the liquid A efficiently.

By reversing the rotation of the fan 17, the air circulation can be changed so as to draw air through the openings 18 and discharge it through the air passage 15.

Figure 25:
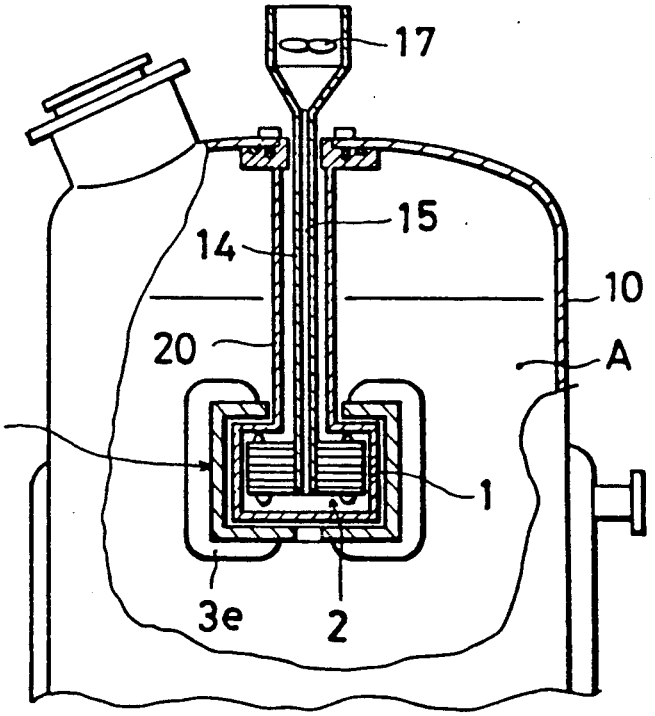
FIG. 25 is a partly cutaway sectional view of a fifteenth embodiment of the invention.

Shown in FIG. 25 is a fifteenth embodiment of the invention, in which a housing 1 is provided in an upper portion of a container 10 and supported on a tubular support member 20 which is pendant from the top wall of the container 10. A pipe 14 is inserted centrally in the support member 20. The lower end of the pipe 14 is fitted in the center hole of the stator 2, while the upper end is spread into a trumpet-like shape to accommodate a fan 17. This embodiment operates in the same manner as the foregoing fourteenth embodiment.

Instead of employing an air-cooled type stator 2 as in the fourteenth and fifteenth embodiments, arrangements may be made to cool the stator by feeding thereto cooling water or other cooling liquid with the use of a pump.

In any of the foregoing fifth to fifteenth embodiments, there may arise the following problem in a situation where the winding is wrapped around the entire circumference of the stator 2.

Figure 26A:
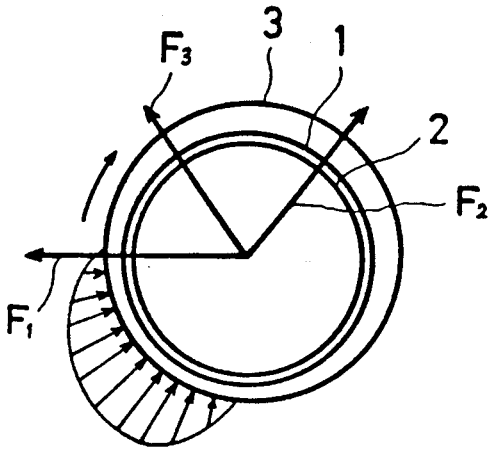
FIG. 26(*a*) and (*b*) are diagrammatic views explanatory of the operation of the rotor in the fifth to fifteenth embodiments.
Figure 26B:
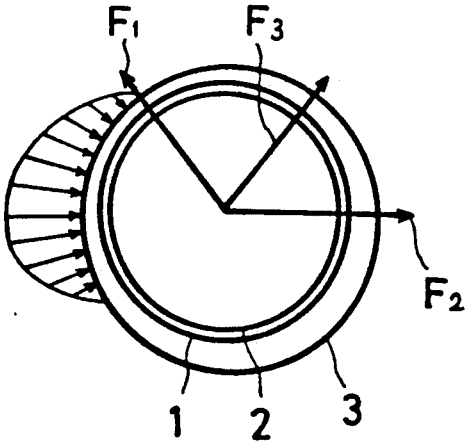

Namely, as power is supplied to the winding of the stator 2, an attracting force $F_1$ is generated in a certain direction by the magnetic field of the winding as shown in FIG. 26*a*, exerting a pulling force on the rotor 3 and producing on the outer side of the housing 1 a liquid film of a wedge-like shape in the direction of rotation. As a result, the liquid between the rotor 3 and housing 1 is pulled in due to its viscosity and generates a liquid pressure with an overall reaction force $F_2$ in the opposite direction. By vector addition of the attracting force $F_1$ and the reaction force $F_2$, a combined force $F_3$ acts on the peripheral wall in the rotational direction. Consequently, as shown in FIG. 26*b*, the rotor is pulled in the direction of the combined force $F_3$, and in this state the attracting force $F_1$ and overall reaction force $F_2$ of the liquid pressure occur in the manner as described hereinabove. Therefore, next the rotor 3 is pulled in the direction of the combined force of the attracting force $F1_1$ and overall reaction force $F_2$. Since the stator 2 has the winding wrapped 360° around its entire circumference, the position where the rotor 3 approaches the housing 1 is shifted sequentially, putting the rotor 3 into eccentric rotational motions and sometimes causing the rotor 3 to hit against the circumference of the housing 1. This makes it difficult to ensure smooth rotation of the rotor.

Figure 27:
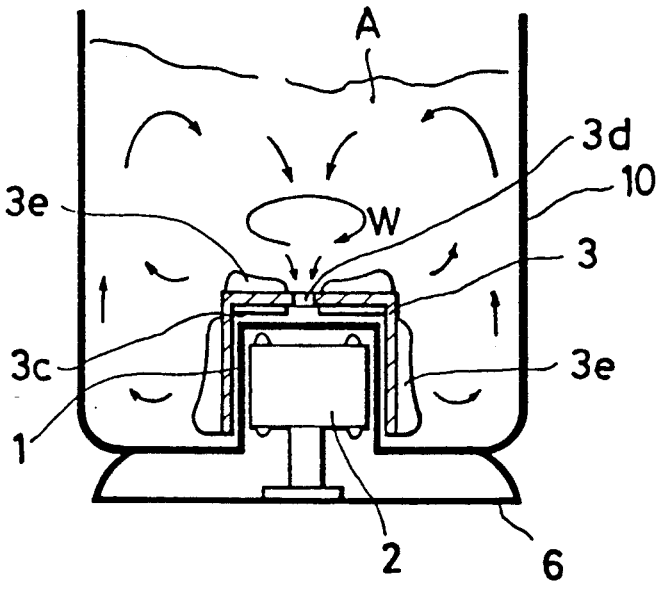
FIG. 27 is a vertical section of a sixteenth embodiment of the invention.
Figure 28:
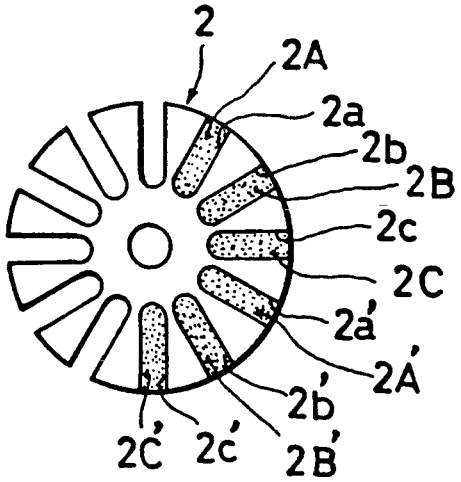
FIG. 28 is a cross-sectional view of a stator.
Figure 29A:
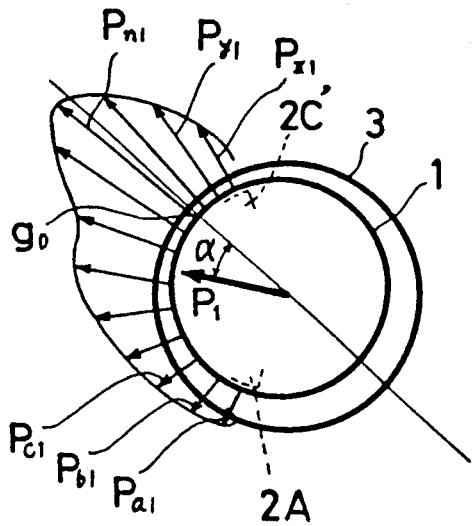
FIG. 29(*a*)through (*e*) are diagrammatic views explanatory of the operation of the rotor.
Figure 29B:
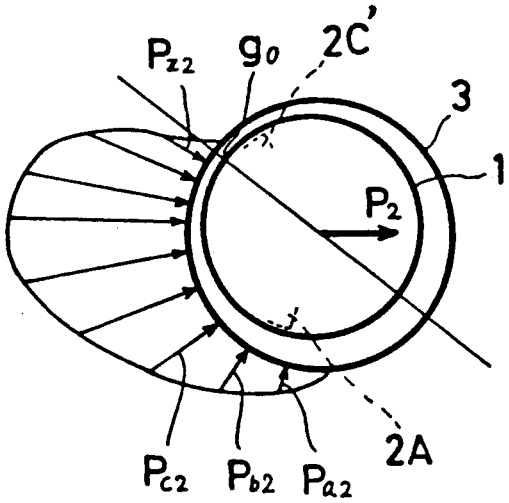
Figure 29C:
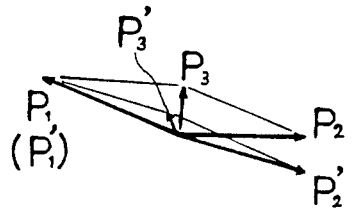
Figure 29D:
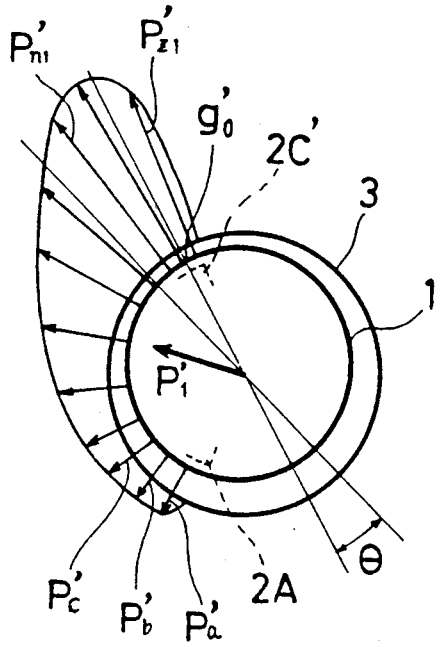
Figure 29E:
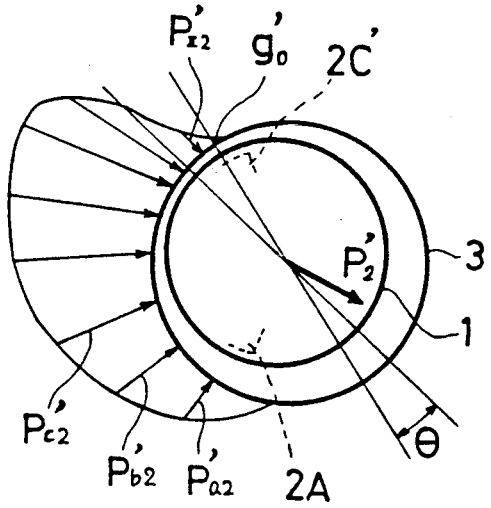
Figure 30:
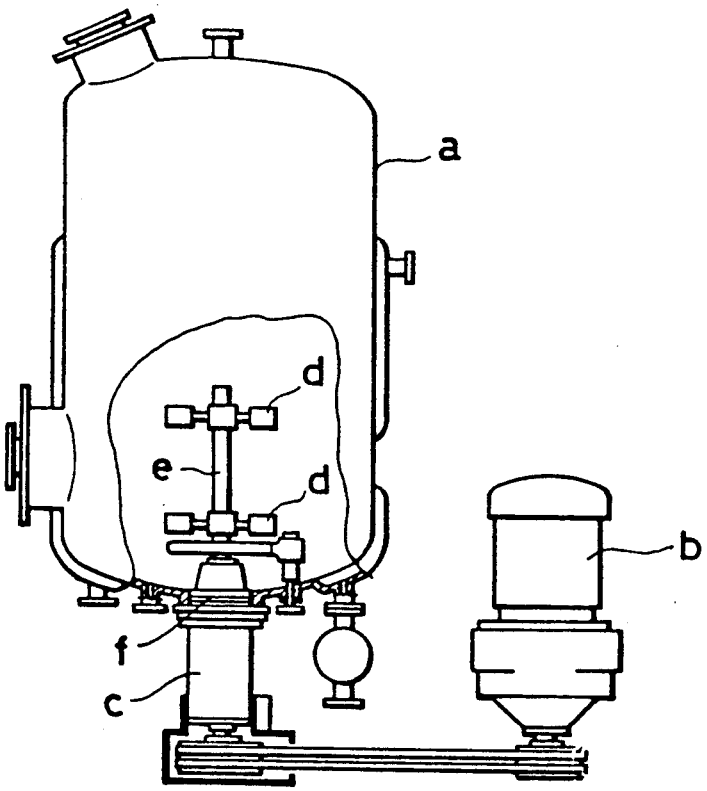
FIG. 30 PRIOR ART
FIG. 30 is a partly cutaway elevation of a conventional stirrer.

In order to overcome this problem, the sixteenth embodiment shown in FIGS. 27 and 28 has stator windings 2A, 2A'; 2B, 2B' and 2C, 2C' wrapped over an angle of 150° in slots 2*a*, 2*a*'; 2*b*, 2*b*' and 2*c*, 2*c*'. Upon supplying current to the windings 2A, 2A'; 2B, 2B' and 2C, 2C', shifting fields are generated in the stator 2 and thereby the rotor 3 on the opposite side of the housing 1 is urged to rotate in the direction of arrow W and at the same time pulled toward stator 2. As a result, the rotor 3 is moved into an eccentric position as shown in FIG. 29*a*, forming a small gap $g_0$ between the rotor 3 and housing 1 with a fluid bearing constituted by the inflowing liquid film. The overall force $P_1$ of the attracting forces $Pa_1$ to $Pz_1$ of the stator windings acts on the rotor 3 across the small gap $g_0$ in the direction of $<\alpha$ short of the small gap position. At this time, pressures $Pa_2$ to $Pz_2$ of the wedge-shaped liquid film act on the rotor 3 and housing 1, and their overall pressure $P_2$ acts as shown in FIG. 29*b*. Accordingly, the combined vector force $P_3$ of the overall attracting force $P_1$ and the overall pressure $P_2$ acts on the rotor 3 as shown in FIG. 29*c*, shifting the small gap $g_0$ through an angle of $\theta$ to $g'_0$. In this state, the small gap $g'_0$ is located in the vicinity of the end of the stator windings where the attracting forces $P'a_1$ to $P'z_1$ of the windings are interrupted in the direction of the rotation as shown in FIG. 29*d*. Therefore, the overall attracting force P'1 is maintained substantially in the same direction as the aforementioned overall force $P_1$. However, as a result of the shift of the small gap from $g_0$ to $g'_0$, the overall pressure $P'_2$ is shifted in the direction of rotation as shown in FIG. 29*e*. Therefore, the combined vector $P'_3$ of the overall attracting force $P'_1$ and the overall pressure $P'_2$ are almost extinguished as shown in FIG. 29*c* to maintain a constant small gap $g'_0$, while the rotor 3 is rotated by the shifting fields of the stator windings. Thus, the rotor 3 tends to move into the eccentric position to form a narrow gap $g_0$ only through a rotational angle of 150° where it is associated with the windings 2A, 2A' to 2C, 2C', and the eccentric displacement does not occur through the remaining angle of rotation. Namely, as the rotor 3 continues its rotation, the eccentric circular movements due to the eccentric displacement are extinguished so as to allow the rotor to smoothly rotate while keeping a constant gap $g'_0$ from the housing and efficiently stirring the liquid A with the vanes 3*e*.

The stator windings 2A, 2A' to 2C, 2C' may be increased or reduced suitably to cover an arbitrary rotational angle, for example, to cover an angle of 180° or 120° if desired.

Needless to say, the rotor can be more smoothly rotated in the fifth to fifteenth embodiments by adopting the partial wrapping of the windings as in the sixteenth embodiment.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by letters patent of the United States is:

1. A stirrer for stirring a liquid, which comprises:

a container within which said liquid is housed and which is mounted on a base;

a stator positioned on said base and located within said container;

a rotor disposed in said container and provided with stirring vanes;

a cylindriaclly shaped housing of nonmagnetic material having a peripheral wall thereof interposed between said stator and said rotor and fluidically rotatably supporting said rotor by said luquid, wherein said stator is located within said housing, and said rotor is in the shape of a cap having stirring vanes on an outer surface thereof and having an aperture in a top wall thereof, said rotor being rotatably fitted on said housing so as to form a small gap between an inner periphery of said rotor and said housing; and a plurality of radially extending grooves formed on one of an inner surface of a top wall of said rotor and a top surface of said housing, wherein a surface is formed contiguously to each of said grooves in such a manner as to narrow the gap between said inner surface of the top wall of said rotor and said top surface of said housing in a circumferential direction.

2. A stirrer as defined in claim 1, wherein said tator has a plurality of windings wrapped around a circumferential part thereof.

3. A stirrer as defined in claim 1, wherein said housing comprises an indented part of a bottom wall portion of said contaienr.

4. A stirrer as defined in cliam 1, wherein said surface formed contiguously to each one of said grooves comprises a stepped surface.

5. A stirrer as defined in cliam 1, wherein said surface formed contiguously to each one of said grooves comprises a sloped surface.

* * * * *